US009546516B2

(12) United States Patent
Acharya et al.

(10) Patent No.: US 9,546,516 B2
(45) Date of Patent: Jan. 17, 2017

(54) SYSTEM AND METHOD FOR SELECTING DRILLING COMPONENTS

(71) Applicant: KUWAIT OIL COMPANY, Ahmadi (KW)

(72) Inventors: Mihira Narayan Acharya, Ahmadi (KW); Qasem Mohammad Dashti, Ahmadi (KW); Ealian Husain Al-Anzi, Ahmadi (KW)

(73) Assignee: KUWAIT OIL COMPANY (K.S.C.), Ahmadi (KW)

( * ) Notice: Subject to any disclaimer, the term of this patent is extended or adjusted under 35 U.S.C. 154(b) by 910 days.

(21) Appl. No.: 13/665,191

(22) Filed: Oct. 31, 2012

(65) Prior Publication Data

US 2014/0121975 A1 May 1, 2014

(51) Int. Cl.
*E21B 7/00* (2006.01)

(52) U.S. Cl.
CPC ..... *E21B 7/00* (2013.01)

(58) Field of Classification Search
CPC ..... G01V 3/32; G01N 24/08; G01N 24/081
USPC ..... 702/9, 24; 703/1; 175/24
See application file for complete search history.

(56) References Cited

U.S. PATENT DOCUMENTS 7,926,588 B2 * 4/2011 Judzis ..... E21B 44/00 175/24
2008/0021653 A1 * 1/2008 Kear ..... G09B 23/40 702/11
2010/0030527 A1 * 2/2010 Prasad ..... E21B 10/00 703/1
2012/0095687 A1 * 4/2012 LeCompte ..... G01V 11/00 702/7
2013/0032401 A1 * 2/2013 Edbury ..... E21B 7/06 175/24

OTHER PUBLICATIONS

Witkowski et al., "Predicting Pyrite and Total Organic Carbon from Well Logs for Enhancing Shale Reservoir Interpretation", SPE Eastern Reg. Meet., Lexington, KY, Oct. 3-5, 2012.*
"Yahoo Answers", https://answers.yahoo.com/question/index?qid=20110724192850AAvFNli, posted 2011.*
Evangelou, "Pyrite Oxidation and Its Control", CRC Press, Boca Raton, 1995.*
Brondel et al. "Corrosion in the Oil Industry", Oilfield Review, Apr. 1994.*
www.thefreedictionary.com/mineralogy.*

* cited by examiner

*Primary Examiner* — Mohamed Charioui
*Assistant Examiner* — Catherine Rastovski
(74) *Attorney, Agent, or Firm* — Richard C. Litman

(57) ABSTRACT

According to one embodiment, a method for selecting drilling components is disclosed. The method may include determining properties of drilling components. The drilling components may include a bottom hole assembly (BHA) and drilling fluid. The properties of drilling components may include BHA properties and drilling fluid properties. The method may also include determining a total organic carbon content in a rock formation unit using a computer. The method may further include determining a pyrite content in the rock formation unit using the computer. The method may still further include determining whether the BHA and the drilling fluid are incompatible for use in the rock formation, based upon the BHA properties, drilling fluid properties, the total organic carbon content, and the pyrite content.

4 Claims, 5 Drawing Sheets

300

320

Stage: 1- Pyrite ($FeS_2$) from Formation (CKS, SDT & DHS) chemically react with water from KFM

302 304 306 308 310 312

$$2\,FeS_2 + 9\,O_2 + 4\,H_2O \rightarrow 8\,H^+ + 4\,SO_4^{2-} + 2\,Fe(OH)_3\,(s)$$

Stage: 2 - Cupper components reacts with byproducts of Stage-1

340

$$Cu(s) + 4\,H^+(aq) + SO_4^{2-}(aq) \rightarrow Cu^{2+}(aq) + SO_2(g) + 2\,H_2O\,(l)$$

322 324 326 328 330 332

FIG. 4

SYSTEM AND METHOD FOR SELECTING DRILLING COMPONENTS

BACKGROUND OF THE INVENTION

Field of the Invention

The disclosure relates generally to selecting drilling components including selecting chemically stable drilling components.

Description of Related Art

Fast and accurate well placement in targeted reservoir units is critical to achieving cost-effective drilling operations. Accordingly, the exploration and production industry has developed systems embedded in the bottom-hole assembly at the bottom of the drill string that facilitate accurate and precise drilling. Measurement while drilling (MWD) and logging while drilling (LWD) systems measure real time drilling information and relay it back to the surface or store it in embedded memory, while geosteering systems enable real-time adjustment of the bottom-hole direction.

Disruptions in these systems can result in off-target placement of the well and drain hole, and cost the entire well operation tens of millions of dollars in high value projects. Physical damage to the bottom-hole assembly and embedded systems may necessitate purchase of replacement and repair components and can delay production schedules.

SUMMARY OF THE INVENTION

According to one embodiment, a method for selecting drilling components may include determining properties of drilling components. The drilling components may include a bottom hole assembly (BHA) and drilling fluid. The properties of drilling components may include BHA properties and drilling fluid properties. The method may also include determining a total organic carbon content in a rock formation unit using a computer. The method may further include determining a pyrite content in the rock formation unit using the computer. The method may still further include determining whether the BHA and the drilling fluid are incompatible for use in the rock formation, based upon the BHA properties, drilling fluid properties, the total organic carbon content, and the pyrite content.

BRIEF DESCRIPTION OF THE DRAWINGS

For a more complete understanding of the embodiments of the present invention, needs satisfied thereby, and the objects, features, and advantages thereof, reference now is made to the following description taken in connection with the accompanying drawings and images.

FIG. 4 illustrates a chain reaction from FIGS. 3A-B.

DETAILED DESCRIPTION

Embodiments of the present invention and their features and advantages may be understood by referring to FIGS. 1-7; like numerals being used for corresponding parts in the various drawings.

Figure 1:
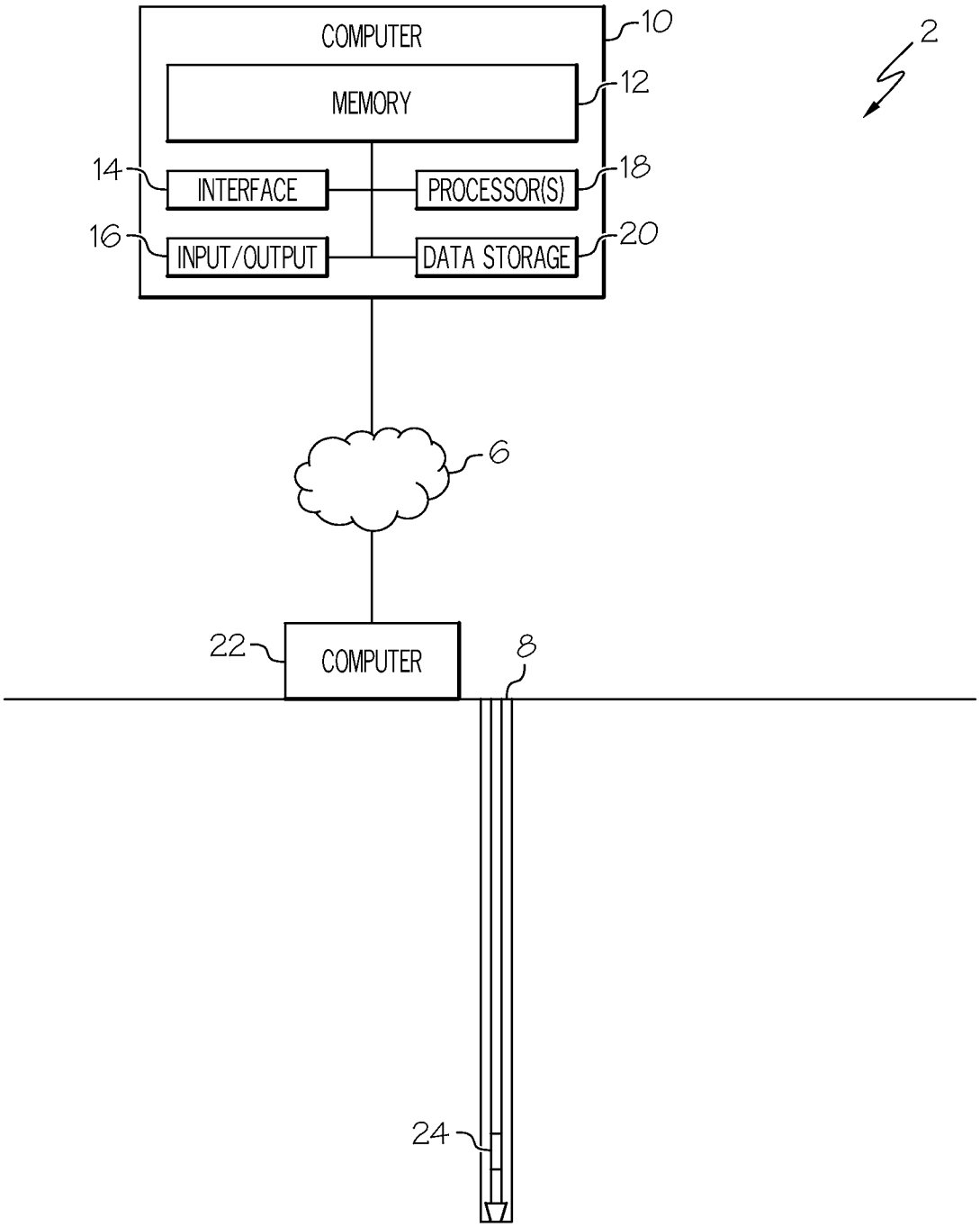
FIG. 1 illustrates a block diagram representing a system for selecting drilling components.

FIG. 1 illustrates a block diagram of a system 2 for selecting drilling components. During exploration and production operations, drill strings come in contact with one or more of minerals and chemicals. For example, native formation minerals mix with drilling fluids during down-hole use in drilling operations. Sometimes, chemical reactions occur between elements of the drill string and foreign minerals while drilling due to catalysts such as one or more of heat and pressure at the base of a bore-hole. Such reactions can cause damage to the drill string and jeopardize drilling operations. System 2 may prevent such damage by checking the compatibility of a drill string, drilling fluid, and rock formation before the drilling operations commence.

System 2 includes a computer 10 comprising a memory 12, an interface 14, an input/output device 16, a processor 18, and a data storage device 20 (e.g., hard disk). Computers 10 and 22 include similar components, and may be connected by a wired and/or wireless network. In one example, a logging while drilling tool (LWD) 24 is disposed in a bottom-hole assembly of a drill string. LWD 24 may communicate with computer 22 at ground level through a wireless communication signal in a particular embodiment, LWD 24 relays formation measurements (e.g., formation density logs) to computer 22 via a wireless signal. In certain other embodiments, a wireline communication network runs down the bore hole with the logging tools to measure formation density if LWD 24 is not deployed in the drill string during drilling, such that measurements may be communicated to computer 22 at the surface. In still other embodiments, LWD 24 retains measurement information in an on-board memory device that is retrieved on the surface after drilling, when the drill string is removed from the bore hole. Computers 10 or 22 may perform the calculations disclosed herein together, by passing measurement information between them. Further, formation data may not be retrieved in system 5, but may come from a drilling service provider or other party with formation density logs. For example, formation data may be input using interface 14 of computer 10. Computer 10 may then perform some or all of the steps disclosed in this disclosure. The network may comprise fewer or more computers that may reside in a laboratory, at a well site, or in a bottom-hole assembly.

Well 8 includes production logging tools and equipment that may be coupled with a computer 22. Computer 22 may receive, collect, analyze, store and/or communicate information regarding well 80 during operation or otherwise.

Computer 22 may be communicatively coupled with network 6 to allow for network communication to or from computer 22. Additional computers may also be in communication with other components of network 6 to allow communication therebetween. For example, in various embodiments, computers 10 or 22 may be associated with a laboratory at which samples are collected and or analyzed. Similarly, computers 10 or 22 may be resident at an enterprise that is responsible for the operation of well 8. Finally, computers 10 or 22 may be used to compile historical information regarding well 8, areas adjacent to well 8, and/or other formations, to allow such data to be used in the equations and analyses referred to below.

In accordance with the teachings of the present disclosure, computer 10 may be used to accomplish the features, functions, analysis and calculations associated with the present disclosure. Each of computers 10 and 22 include computer hardware and software components, including an interface 14 (hardware interface and/or software interface), processor(s) 18, and data storage 20 (e.g., memory storage device) to facilitate the features and functions described herein.

The computers and components described herein may include input devices, output devices, mass storage media, processors, memory, interfaces, communication ports, or other appropriate components for communicating among computers 10 and/or 22. For example, computers may include a personal computer, workstation, network computer, kiosk, wireless data port, personal data assistant (PDA), one or more Internet Protocol (IP) telephones, one or more processors within these or other devices, or any other suitable processing device. As a particular example, computer 10, for example may include a computer that includes an input device, such as a keypad, touch screen, mouse, or other device that can accept information, and an output device that conveys information associated with the operation of other computer or network components, including digital data, visual information, or any other suitable information. Both the input device and output device may include fixed or removable storage media such as a magnetic computer disk, CD-ROM, or other suitable media to both receive input from and provide output to a user of the computers.

The computers may be local to or remote from other computers, network components, or well 8. Although a particular number of computers are illustrated, the present disclosure contemplates any suitable number of computers, according to particular needs.

Each computer may include a browser or other suitable interface for accessing information over network 6. For example, the browser may present various web-enabled data feeds and receive commands from the computer. A browser may include any suitable interface for submitting requests for and displaying media such as web pages. It should be understood that the term "browser" may be used in the singular or in the plural to describe one or more browsers and each of the displays of a particular browser.

Network 6 facilitates wireless or wireline communication. Network 6 may communicate, for example, IP packets, Frame Relay frames, Asynchronous Transfer Mode (ATM) cells, voice, video, data, and other suitable information between network addresses. Network 6 may include one or more local area networks (LANs), radio access networks (RANs), metropolitan area networks (MANs), wide area networks (WANs), all or a portion of the global computer network known as the Internet, and/or any other communication system or systems at one or more locations.

Each computer includes one or more electronic computing devices operable to receive, transmit, process, and store data associated with system 10. For example, each may include one or more general-purpose personal computers (PCs), Macintoshes, workstations, Unix-based computers, server computers, or any other suitable devices. In short, each computer may include any suitable combination of software, firmware, hardware, and any other suitable components.

Figure 2:
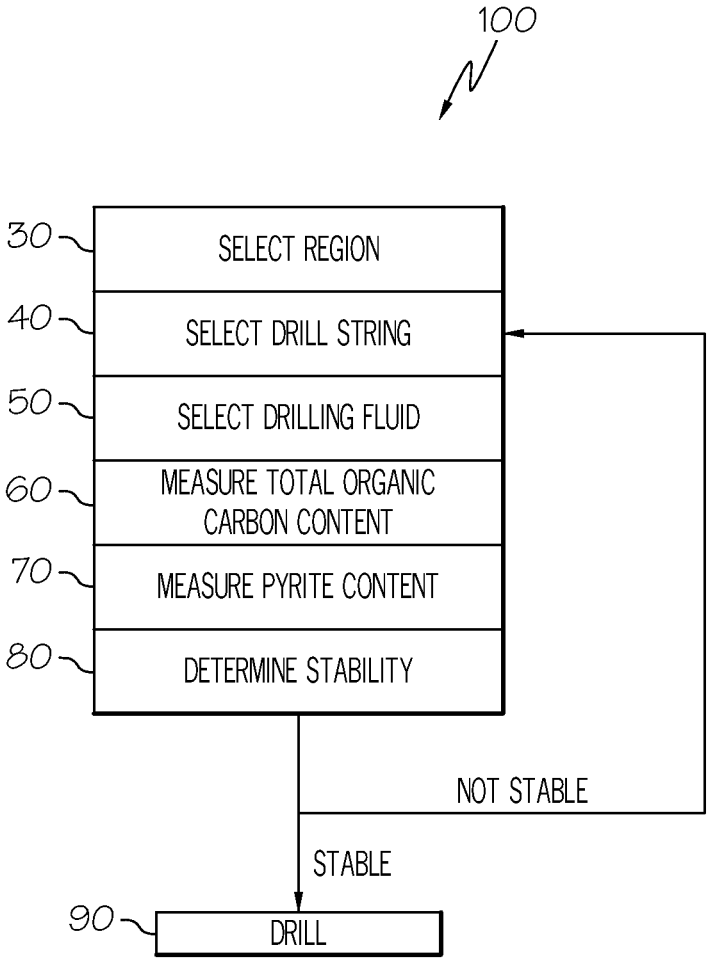
FIG. 2 illustrates a flowchart representing a method for selecting drilling components.

FIG. 2 illustrates a method 100 for selecting drilling components that may prevent damage to drill string components and may be implemented in system 2 from FIG. 1. Method 100 considers drill string metallurgy, drilling fluid chemical composition, total organic carbon content of the rock formation and pyrite content of the rock formation and may determine if the components may be chemically stable during drilling operations with catalysts present. Referring to FIG. 2, region 30 may be selected for one or more of testing, and production operations. In a particular embodiment, region 30 comprises a carbon rich lithographic unit, such as a kerogen unit, and comprises a pyrite rich lithographic unit. A drill string 40 may be selected for the drilling operations. For example, drill string 40 may comprise one or more of copper (AKA, and hereinafter "cupper") and beryllium components. A drilling fluid 50 may be selected to lubricate drill string 40 and/or carry rock filings to the surface during drilling. Drilling fluid 50 includes, among other things, a water-based drilling fluid. A total organic carbon content (TOC) 60 corresponding to one or more of each lithographic unit in region 30 may be measured. TOC 60 may be measured by processing formation bulk density logs and may be calculated by using one or more of computers 10 and/or 24. TOC 60 may comprise a weight % of organic carbon content in one or more of each lithographic unit in region 30. A pyrite content 70 corresponding to one or more of each lithographic unit in region 30 may be measured. In one example, pyrite content 70 is measured by processing elemental capture spectroscopy scans using a computer. The elemental capture spectroscopy scan may be performed using results from an offset well in region 30. Pyrite content 70 may comprise a weight of pyrite content in one or more of each lithographic unit in region 30. The chemical stability of the drilling components (e.g., drilling fluid and drill string) may be determined by considering drill string 40, drilling fluid 50, TOC 60, and pyrite content 70. For example, if drill string 40 metallurgy comprises cupper, drilling fluid 50 comprises a water-based drilling mud, pyrite content 70 comprises 7 weight %, and TOC 40 comprises 14 weight %, the drilling components may be unstable and new drilling components may be selected. In such rock formation units, alternate tool components should be used to ensure tool recovery and accurate well placement.

Method 100 identifies rock formation units where down hole electrolytic flotation (DHEF) may likely occur. DHEF refers to a chemical mining process in which ore may be extracted during mining by means of a froth flotation process. The froth flotation process refers to the process in which elements may be separated from mined ores and floated to the surface of a bore-hole. A drilling fluid may be conditioned with reactive reagents. The reagents chemically react with mineral filings in the bore-hole and attach to specific mineral ores. When clipper ore is targeted for extraction the drilling fluid reagents may attach to clipper. When reagents react, the clipper is brought to the surface. Drilling fluid that has not reacted with cupper ore is strained, re-conditioned, and re-used in a second mine phase. The DHEF process may occur unintentionally in oil exploration and production drilling operations. Method 100 for selecting components analyzes rock formation units and may determine units where drill string 40 metallurgy may react with drilling fluid 50 and the formation unit composition to produce conditions similar to DHEF. DHEF may be responsible for unpredictable damage to cupper string 40 components in pyrite and organic rich lithographic units.

In a particular embodiment, the drilling components comprise one or more of drill string 40 and drilling fluid 50. Industry standard drill strings, such as drill string 40, may comprise one or more of cupper and beryllium. Drill string 40 may be expensive and difficult to replace. Drilling operations sometimes occur in remote regions, such as on off shore rigs or remote desert regions, where shipping replacement drill string 40 parts is difficult and time consuming. Damage to drill string 40 may delay the drilling time by requiring replacement parts to be shipped to the remote rig locations. These delays may be avoided with method 100 for selecting drilling components.

Drilling fluid 50 includes, among other things, potassium formate and water, and may further include viscosifying agents. Viscosifying agents aid in drilling and fracking operations. When under pressure in the bore-hole, drilling fluid 50 is forced into one or more of pores, cracks, and fractures. Viscosifying agents prop open one or more of pores, cracks, and fractures in reservoir rock surface and allow hydrocarbons to be extracted or drain out of reservoir units and into an oil well. Viscosifying agents may contain xanthate. Xanthate acts as a reagent in the DHEF process and may excite damaging reactions involving one or more of the drill string, oxygen, water, and pyrite.

In a particular embodiment, the robustness of MWD and LWD tools were laboratory-tested and field-tested for expected operating and measurement specifications. To mitigate the risk of disruption or failure while drilling, drilling fluid suppliers often lab-test their products with bottom-hole assemblies under simulated down-hole conditions. However, sometimes these experiments cannot account for every combination of native substances encountered over the course of drilling. Further, electrical fields and reactants encountered during drilling can excite ions and activate reactions that may not otherwise occur, causing unpredictable tool damage and disruptions to drilling systems. The unique conditions experienced while drilling in deep rock formations are difficult to predict and simulate in a laboratory test.

LWD and MWD tools have been used in the oil exploration and production industry for decades with a proven track record of stability. However, a typical tool string deployed as a part of a bottom-hole assembly (BHA) failed to withstand the unexpected bottom-hole conditions during pilot hole drill with potassium formate mud (KFM), a heavy water-based mud. The failure occurred within a deep-fractured calcareous kerogen section (CKS). The drilling tools had multiple surface communication failures. The first communication failure was caused by debris obstructing the rotor-starter device of the drill string before drilling into the CKS. The second failure occurred in the back-up tools, after drilling into the CKS and remained unexplained throughout drilling with the expectation that bottom-hole data was recorded in memory. Inspection of the tool components, once the drilling was completed, revealed three possible sources of tool failure. First, some parts of the BHA, specifically the components of the cupper-beryllium tool corroded. Second, the recovered tool parts sustained further damage due to abrasion and pitting. Third, an unexpected color change in the metal body parts was observed.

The damage to the tool parts and tool failure may be explained by the DHEF process. The cause of the damage was hard to characterize because of the uniqueness and unusualness of the drilling components and rock formation. In fact, similar tools were previously used without any problems at comparable high pressure and temperature conditions and in similar geological sections while drilling with oil-based mud. Operational experience in other fields failed to explain the damage. For example, drilling service providers successfully operated the tools with KFM in other fields, and this success was confirmed with metallurgical compatibility tests.

In another example, a combination of a SCHLUMBERGER® SlimPulse Retrievable MWD tool to measure inclination and direction and gamma ray and a SCHLUMBERGER® mcrVISION Resistivity LWD tool to measure resistivity in the BHA is deployed in drilling a deviated pilot hole through a CKS. Drilling service providers claim such tools to be compatible with water-based mud systems, and, in particular, with KFM. The other drilling components used may have been within the tools' operating specifications. For example, other drilling components included 16.9 ppg KFM drilling fluid, weighted with manganese tetroxide (i.e. Micromax). The components were stable at temperatures between 250°-275° F., with mud solid contents, pump rates and other parameters also within the tools' operating specifications. The advantage of using this combination of drilling components is that the tool parts are fully retrievable and are fully replaceable if a pipe gets stuck in the bore-hole during drilling. Thus, such a combination lowers the probability of down-hole tool loss.

When drilling with such a combination of components, two surface communication failures occurred while drilling the pilot hole. Details of the tool failures for a particular example are provided below.

First surface communication failure,

- Real-Time Communication to Surface Stopped After:
- 28 pumping hours
- Drilling from 118' of fresh formation
- Predominantly limestone (NH) section at 73'
- Drilling 35' into kerogen (NJK) section with an average rate of penetration (ROP) 30-35 ft/hr
- Pull out of hole (POOH) without circulation @ XX410' with a lag time over 2 hours
- Observations at Surface
- Debris in pulsar housing (mostly pipe scales)
- Stoppage of pulsar functioning due to jamming
- Loss of signal.
- No unusual damage to tool
- Cupper-beryllium housings in good condition
- Overall tool parts were not visibly affected (mechanically or chemically)

Second surface communication failure. This failure occurred in back up tools, after replacing the damaged tools with the back-up tools.

- Real-Time Communication to Surface Stopped after:
- 25 pumping hours
- Drilling from 147' of fresh formation
- Predominantly CKS (NJK+NJM) section (127')
- Drilled 20' into SRL @ XX557'
- Change of average ROP
  - 15-35 ft/hr in CKS
  - 5-10 ft/hr in SRL
- Continued drilling 280' without RT data, up to TD @ XX837' in DHS
- POOH after 55 pumping hours (after OH clean out from 10¾" shoe+bottoms up circulation)
- Observations at Surface:
- No Debris in pulsar housing (as seen in first incident)
- Vanishing tool parts mostly with cupper-beryllium metallurgy Light blue shade on the tool surface of recovered cupper-beryllium parts Peripheral blue shading across the corrosive holes and pits.

Both corrosive damage to cupper-beryllium components and erosional (Non-mag) damage Mud flooding into battery sections of the tool No memory data retrieved Overall tool parts may have been severely affected (mostly chemically and partly mechanically)

A corrosive chain reaction with the tool metallurgy may explain such unusual tool failure. The tool metallurgy had a stable chemical compatibility with the mud system. Service providers discovered cases of corrosive and abrasive damage to tools in KFM with slight corrosive effects observed. However, these cases failed to explain the severity of the tool failure. The tool failure poses mechanical and chemical challenges in terms of key operational parameters such as mud flow rate, temperature, pressure, ROP, down-hole vibration and shocks, and mud composition etc. Operators have conducted experiments in which they have drilled through organic rich reservoirs in unconventional shale gas/oil plays, but analogous incidences were not reported.

The DHEF reaction may require 3 critical end members to complete the process, and may result in combustion. For example, electrolytic flotation may was investigated on pyrite. The experiment was enhanced by xanthate and a cationic collector. Cupper sulfate depressed pyrite flotation, while it activated flotation at the pH range 8.0-12.0. In such an example, lime was used to modify the pH. Cu (II) ions interacted with pyrite (FeS2) surfaces in an aerated aqueous solution (pH 4-10) and the interaction influenced subsequent ethyl xanthate adsorption from the solution, Cu (II) ions are adsorbed independent of their pH, and change their oxidation state to Cu (I) as a new Cu—S surface species. Cu (II) is stabilized as a complex hydroxy species on mite at pH≥6.

The DHEF reaction may not occur if all elements are not present in the model. This was proved in laboratory tests with water-based KFM and cupper-beryllium tool parts. Corrosive reactions and tool damage were only observed from the previously mentioned root causes and possible chemical reactions, such as, for example, the chain reactions between cupper-beryllium tool parts and unusually organic rich CKS formations with up to 12 weight % of pyrite (FeS2) concentration in a water-based KFM system.

A down-hole environment with a temperature of 2600° F. and high pressure with equivalent circulation density (ECD) down-hole of 17.3 ppg and drilling circulating agitating conditions acted as catalysts to favor the DHEF process. The float frothation mechanism may be replicated in down-hole drilling conditions such that it activates and may continue the DHEF chain reaction. Such conditions may explain the down-hole tool damage. The stages of the chemical reaction that may explain the corrosive reaction and may dissolve Cu tool parts are outlined below.

Stage: 1—Pyrite (FeS2) from CKS formation may react with water from KFM $$2\ FeS2+9\ O2+4\ H2O \rightarrow 8\ H++4\ SO42-+2\ FE(OH)3(s)$$

Stage: 2—Cupper components may react with byproducts of Stage-1

$$Cu(s)+4\ H+(aq)+SO42-(aq) \rightarrow Cu2+(aq)+SO2\ (g)+2\ H2O\ (l)$$

The detailed steps of the process, as associated with a particular embodiment, are explained below:

1. When combining the pyrite and water-based mud (e.g., KFM) in the down-hole environment, FeS2 (pyrite) reacts with water and dissolved molecular oxygen to form sulfate and iron oxyhydroxides. Carbonate pH buffer properties are limited and effective for moderate carbonate concentrations in the pyrite dissolution process.

2. Mud chemical BARAZAN® D, a powdered Xanthan gum polymer used to viscosify fresh water, seawater and monovalent brines, is used as a viscosifier in the KFM. BARAZAN® D viscosifier is treated with a dispersant that may help improve mixing and may promote the yield of the product with reduced amounts of shear as compared to BARAZAN® viscosifier, BARAZAN® D viscosifier provides suspension and sheer thinning properties and may be used up to 250° F. (121° C.).

3. Apart from above mud chemical source of xanthan, the organosulfur compounds such as Xanthate, naturally associated with fossil fuels, are readily available in high organic rich source rocks of the CKS. Xanthate salts may be used as flotation agents in mineral processing. Potassium ethyl xanthate may be an organosulfur compound with the chemical formula CH3CH2OCS2K. Such compounds resemble a pale yellow powder that is used in the mining industry for the separation of ores.

4. KFM with pH (11-12), provides the requisite environment for potassium ethyl xanthate—a pale yellow powder, that is relatively stable at high pH but rapidly hydrolyses at pH<9 at 25° C. Unlike the sodium derivative, potassium xanthate crystallizes as the anhydrous salt and is non-hygroscopic. Potassium ethyl xanthate is predominantly used in the mining industry as a flotation agent for extraction of cupper, nickel, and silver ores. Method 100 may exploit the affinity of such "soft" metals for the organosulfur ligand.

Thus the components required for the complex geochemical DHEF chain reaction exist in the presence of catalysts and flotation reagent, naturally associated with source rocks, coals and fossil fuels. Such naturally occurring formations explain the mystery of the tool damaging phenomena. The down-hole activities of pumping, circulation, agitation, grinding across the formation outside and affected tool components inside the tool annulus replicates the float frothation process. The temperature and pressure down-hole aggravates the reaction and acts as a catalyst. Such factors combine to account for the chemical melting of the robust tool metallurgy of cupper-beryllium.

In a particular embodiment, an operating envelope is established. The operating envelope, or compatibility limitation, of the formation may be 5-10 wt. % pyrite and TOC>12 wt. %. Such an operating envelope is applicable when using LWD/MWD tools with cupper-beryllium metallurgy deployed with water-based KFM. For example, if a production company plans to drill with water-based mud and cupper tool parts in a specific area, subsurface scans are conducted to determine whether any of the formation units may comprise readings within the operating envelope. If the region contains units with element concentrations within the prescribed envelope, then such drilling components may be damaged by drilling operations in the region. Such an operating envelope may be deployed as a pre-drill compatibility check in unique unconventional combinations and may save critical data lost to damaged tool parts, time, revenue and operational difficulties in E&P industry. Such a test may be applied in other fields with similar reservoirs. Real time communication failure causes serious difficulties for well placement and geosteering operations in targeted reservoir units, and is critical for achieving well objectives.

Direct and indirect losses may be incurred from conducting drilling operations in regions with rock formation units within the operating envelope. Losses may range from rig time to tool costs to losing the valuable logging data from the tool's on board memory. The absence of real time data may result in serious off-target placement of the well and the drain hole in the high angle and horizontal well respectively. Such misplacements may cost the drilling project tens of millions of dollars in high value projects.

Figure 3B:
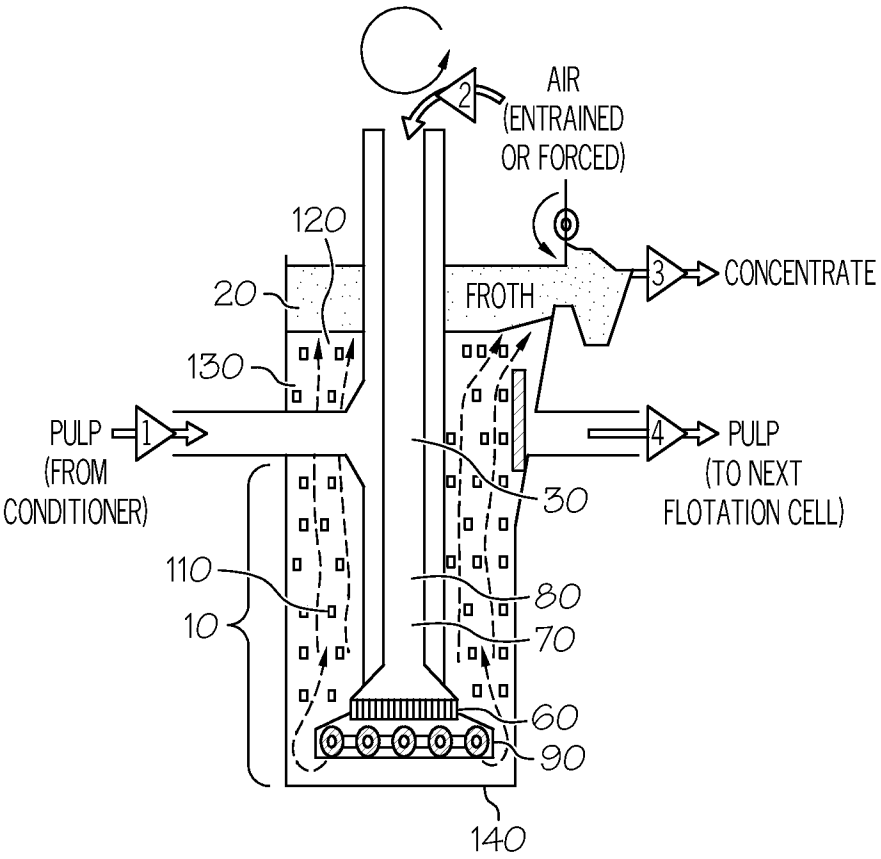
FIG. 3B illustrates a diagram of a float frothation mining process.
Figure 3A:
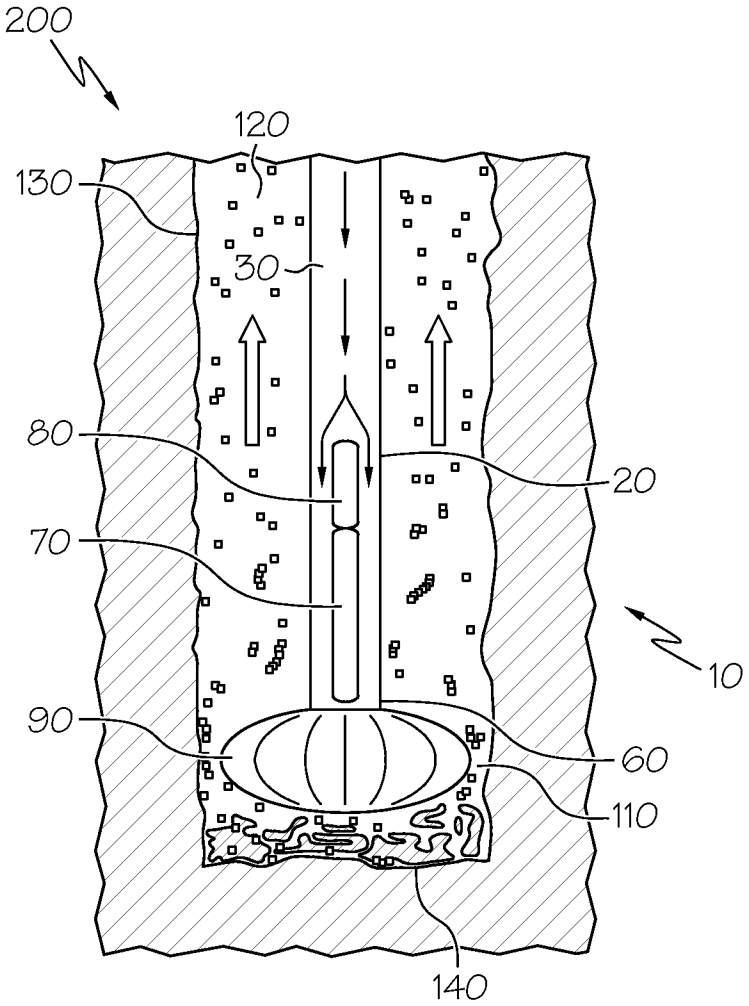
FIG. 3A illustrates a diagram of a down hole drilling process.

FIGS. 3A and 3B illustrate drilling systems that experience damaging and disruptive chemical reactions. Referring to FIGS. 3A and 3B, system 2 for determining the chemical stability of drill components may detect a rock formation unit 10 where drilling operations cause damage to a drill string 20. The system for determining the chemical stability of drilling assemblies may prevent damage caused by drilling elements in combination with certain subsurface minerals, present in unit 10.

Drill string 20 comprises a bottom-hole assembly 60, disposed at the bottom of drill string 20. Bottom-hole assembly 60 comprises an LWD 70, an MWD 80, and a geosteering system. LWD 70, MWD 80, and the geosteering system gather real time formation data and may facilitate well placement and formation evaluation in well profiles. LWD 70 and MWD 80 may scan formation unit 10 around the bore-hole and may report information back to the surface. Operators at the surface may then control the geosteering system to position a drill bit 90. Drill bit 90 may direct the drilling direction, and may facilitate precise well placement. Such systems may comprise one or more of circuit boards, electronic wiring, and memory devices. Such systems may be valuable and expensive to replace. LWD 70, MWD 80, and the geosteering system may experience one or more of high temperatures and vibration stresses. These conditions may induce system failure during deployment. The system metallurgies, however, are expected to withstand the impact of one or more of mechanical and chemical conditions during drilling, and 70, MWD 80 and the geosteering system are expected to function with different drilling fluids. Drill string 20 manufacturers may focus engineering efforts on durable composition of bottom-hole assemblies to protect these systems. However, despite the engineering focus on protecting these systems, unique and evolving chemical environments present challenges in securing vulnerable bottom-hole assembly systems.

FIG. 3A depicts an oil exploration and production environment drilling system 200. Drilling system 200 may pump drilling fluid 30 down drill string 20. Drilling fluid 30 may flow around MWD 80 and LWD 70 systems and through drill bit 90. Drilling fluid 30 may lubricate drill bit 90 and may flush away rock shavings 110 produced during the drilling process. MWD 80 and LWD 70 systems may rely on drill string 90 casing for protection from contact with drilling substances and foreign rock shavings 110. Drilling fluid 30 may comprise a water-based mud. Water-based mud may comprise potassium formate and water. Drilling fluid 30 then carries the mineral shavings back up through an annulus 120 of the well, around the outside of drill bit 90 and drill string 20 and inside of a well casing 130. Well casing 130 may comprise concrete, and may insulate annulus 120 of the well from exterior rock formation unit 10 and wells. The downward pressure of drilling fluid 30 in drill string 20 may provide a force. Such force may carry drilling fluid 30 back up annulus 120 of the well. The viscosity of drilling fluid 30 may be such that it may carry rock shavings 110 back up well annulus 120 to the surface of the well.

Rock formation unit 10 may comprise a calcareous kerogen section and may comprise high quantities of pyrite and organic rich content. Drill string 20 may comprise a cupper-beryllium metallurgy. Base of bore-hole 140 may be 300 degrees Fahrenheit. Base of bore-hole 140 may comprise pressure between 100 and 500 psi. Drilling fluid 30 and rock shavings 110 may be circulated around the drill hit. Rock shavings 110 may comprise an electrical potential due to latent potentials in ionic rock pore spaces. Drilling fluid 30 may circulate electric potentials with other reagents and may come in contact with drill string in annulus 120 of well. Such electrical potential may excite chemical reactions when reagents are present. Such electrical potentials may produce electric fields.

Base of bore-hole 140 may comprise the reagents and catalysts required to create a corrosive reaction with the cupper surface of drill string 20. The grinding of drill bit 90 and circulation of one or more of rock shavings 110 and drilling fluid 30 create and transfer an electrochemical potential that may activate reactions between the pyrite in rock shavings 110 and water-based potassium formate drilling fluid 30. Such reactions may produce sulfate and iron oxyhydroxides. Solid cupper, as present in drill string 20, sulfate, and aqueous hydrogen cations may react to form water, suffer dioxide, and aqueous cupper (II) cations. Such a chain reaction may corrode drill string 20, and damage LWD 70 and MWD 80 systems on board. Such chain reactions may occur during DHEF processes.

FIG. 3B depicts a froth flotation mining process. The froth flotation process may demonstrates corrosive effects of DHEF chain reactions on cupper elements of drill string 20. In the illustrated embodiment, oxygen and drilling fluid 30 may be pumped down drill string 20. Base drill string 20 may comprise LWD 70, MWD 80, and a geosteering system. Drilling fluid 30 may be pumped through drill string 20 and out the drill bit 90. Drilling fluid 30 may lubricate and carry off rock shavings 110 from drill bit 90. Drilling fluid 30 may comprise a water-based potassium formate drilling fluid and oxygen from the surface. Drilling fluid 30 density may be such that drilling fluid 30 may carry rock shavings 110 up well annulus 120 between the outside of drill string 20 and well casing 130. Drilling fluid 30 may comprise collector chemicals or flotation reagents that may react with one or more of cupper ore and other rock shavings 110. At the surface, rock shavings 110 and other impurities may be collected, and the clean drilling fluid may be circulated back through the system. Different additives and chemical reagents may be introduced into drilling fluid 30 to one or more of break down, react, and bind with ore molecules. For example, drilling fluid 30 may comprise potassium ethyl xanthate. Potassium ethyl xanthate is an organosulfur compound that may separate ores like cupper, nickel, or sulfur. Potassium ethyl xanthate may act as a flotation agent that may carry the extracted metals up to the surface for extraction. In the depicted embodiment, the extracted metal may be cupper from drill string 20.

At base of bore-hole 140, pyrite rock shavings 110 may come in contact with the water-based potassium formate drilling fluid 30. Pyrite rock shavings 110 may reacts with one or more of water from drilling fluid 30 and dissolved molecular oxygen latent in drilling fluid 30 from surface. Base of bore-hole 140 may be 200-300 degrees Fahrenheit. The pressure at base of bore-hole 140 may be 100-500 psi. Base of bore-hole 140 may comprise one or more of an electric field or an electrochemical potential. Such combination of reagents and catalysts may react to form sulfate, iron oxyhydroxides and hydrogen cations. The sulfate and hydrogen cations may react with the solid cupper components in drill string 20 to form aqueous cupper (II) ions and sulfur dioxide. The cupper (H) ions may bind with xanthate. Xanthate may occur naturally in organic rich cancareous kerogen rock formation unit 10. Xanthate may be present as a viscosity additive in drilling fluid 30 in the form of potassium ethyl xanthate. Xanthate may act as a flotation reagent for carrying dissolved cupper (II) ions up well annulus 120 to the well surface, Down hole activities (e.g., pumping, circulation, agitation, and grinding) across rock formation unit 10 may replicate a standard froth flotation process, such as the process for mining cupper. The cupper may not be, for example, comprised in ore. The cupper may instead be comprised in drill string 20. The temperature and pressure at base of bore-hole 140 may act as a catalyst for the DHEF reactions. Such reactions may result in chemical melting and corrosive effects on drill string 20. When drill string 20 surface has corroded through, reactive drilling fluid 30 may enter interior of drill string 20. Reactive drilling fluid 30 may one or more of damage and destroy on board systems such as LWD 70, MWD 80 and the geosteering system. Debris may get lodged in drill string 20 and may disrupt drilling operations and surface communication. Once such systems may have been damaged, drilling navigation and well placement accuracy may become impeded.

FIG. 4 illustrates the chain reaction that may occur in the drilling and mining systems from FIGS. 3A-3B. Chemical reactions 320 and 340 may form a chain reaction 300. Chain reaction 300 may corrode cupper drill string components when the illustrated reagents are present. Chain reaction 300 may comprise a first reaction 320. In first reaction 320, pyrite reagent 302 may combine with oxygen reagent 304 and water reagent 306. Such combination of reagents may react to form one or more of hydrogen cations 308, sulfate anions 310, and iron (III) hydroxide 312. Pyrite reagent 302 may be abundant in source rock formation mineral shavings. Rock formation mineral shavings may be produced by drilling operations. Oxygen reagent 304 may be abundant in recycled drilling fluid from the surface. When drilling fluid pumps through the drilling system, it may be recycled many times through the drilling system. At the surface, drilling fluid may mix with oxygen reagent 304 and may carry dissolved oxygen reagent 304 particles deep into the borehole. Water reagent 306 may be abundant in water-based drilling fluid.

A second reaction 340 in chain reaction 300 may comprise solid cupper reagent 322, hydrogen cation reagent 324, and sulfate anion reagents 326. Such reagents may react to produce one or more of aqueous cupper cations 328, gaseous sulfur dioxide 330, and water 332. Cupper cations 328 may be dissolved and carried to the surface.

One or more of drilling, grinding, circulating, pressure, and heat may excite chain reaction 300. Chain reaction 300 may recur until cupper reagent 322 in the drill string has been consumed. More likely, the drill string LWD and MWD components may lose communication with the surface, and the drill bit electronics may tail before cupper reagent 322 in the drill string has been consumed completely. Chain reaction 300 may comprise one or more of the DHEF and froth flotation processes.

Figure 5C:
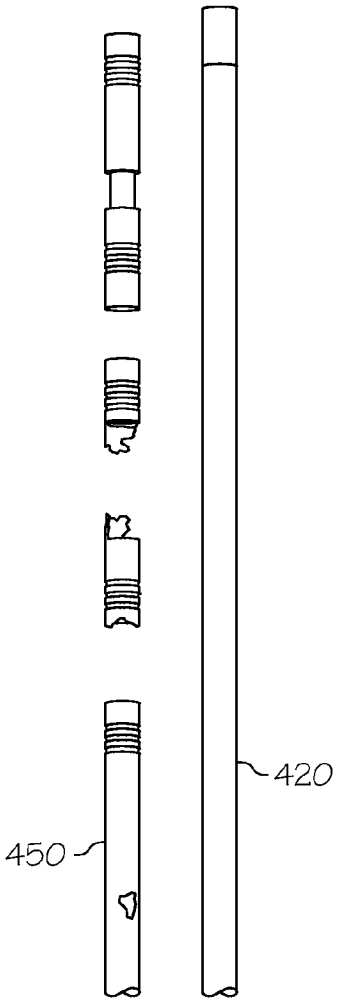
FIG. 5C illustrates a side view of copper-beryllium parts of MWD and LWD tools in a BHA before and after they have been corroded by drilling with chemically unstable components.
Figure 5B:
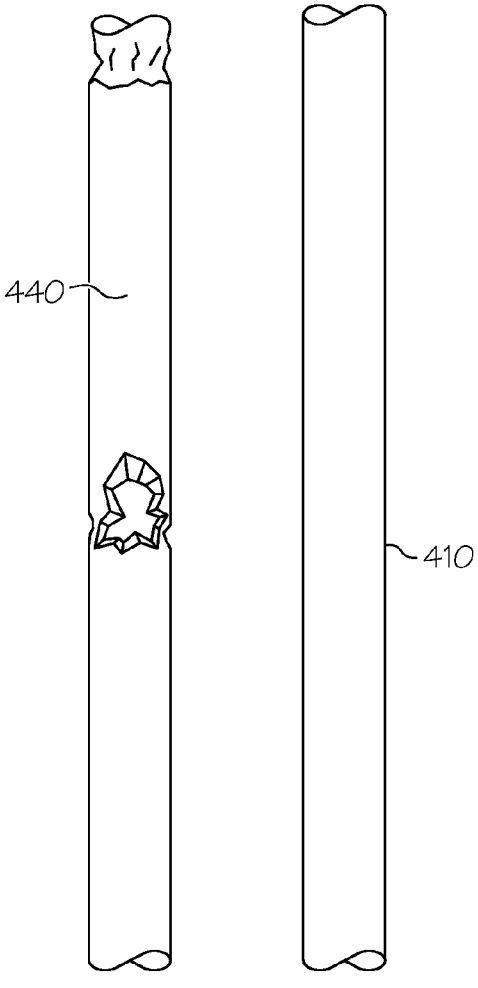
FIG. 5B illustrates a side view of copper-beryllium parts of MWD and LWD tools in a BHA before and after they have been corroded by drilling with chemically unstable components.
Figure 5A:
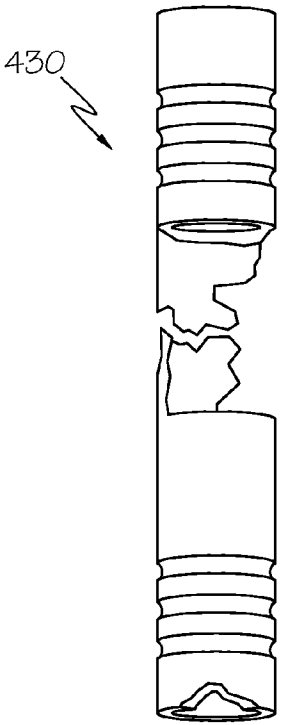
FIG. 5A illustrates a side view of copper-beryllium parts of measurement while drilling (MWD) and logging while drilling (LWD) tools in a bottom hole assembly (BHA) that have been corroded by drilling with chemically unstable components.

FIGS. 5A-C illustrates side views of cupper-beryllium parts of measurement while drilling (MWD) and logging while drilling (LWD) took in a bottom hole assembly (BHA) that have been corroded by drilling with chemically unstable components and may illustrate components in the method for selecting drilling components of FIG. 2. Drill string 440 and 450 shows the effect of the DHEF corrosive reactions on industry standard drill strings. For example, drill string 440 and drill string 450 are pictured before experiencing corrosion during drilling operations as drill string 410 and drill string 420 respectively, and were salvaged from wells where chemically unstable drilling components were used. In particular, the well comprised high pyrite and high organic carbon content. Drill collar 430 is designed to protect LWD, MWD, and geosteering systems inside the drill string assembly. However, drill collar 430 was also salvaged from a drill string assembly where LWD, MWD, and geosteering system surface communication was severed. The method for selecting drilling components may have prevented the damage in drill string 440, drill string 450, and drill collar 430.

Method 100 for selecting drilling components from FIG. 2 may use offset well bulk density graphs in computing the TOC of rock formation units. Bulk density information may have a transform applied to it in order to obtain a TOC estimate for the region. Such estimation may be preferred to collecting rock samples from each unit and conducting laboratory tests to determine the TOC of each unit. One or more of these TOC calculation methods may be used in the method for selecting drilling components.

The method for selecting drilling components from FIG. 2 may use offset well ECS results 602 in determining the pyrite content of rock formation units. If the pyrite content at an interval in a rock unit goes over an established threshold, the method for selecting drilling components may recommend selecting different drilling components for that unit, particularly when a cupper drill string is selected.

While the disclosure has been described in connection with various embodiments, it will be understood by those of ordinary skill in the art that other variations and modifications of the various embodiments described above may be made without departing from the scope of the invention. Other embodiments will be apparent to those of ordinary skill in the art from a consideration of the specification or practice of the embodiments of the invention disclosed herein. The specification and the described examples are considered as exemplary only, with the true scope and spirit of the embodiments of the disclosure indicated by the following claims.

What is claimed is:

1. A computer-assisted method for selecting drilling components for a selected region having a rock formation unit, the method comprising the steps of:

determining properties of drilling components, the drilling components comprising a plurality of bottom hole assemblies (BHAs), wherein the BHAs include a drill string and a plurality of drilling fluids, the properties of the drilling components comprising BHA properties and drilling fluid properties, wherein the BHA properties include at least a metallurgy of the drill string and the drilling fluid properties include a chemical composition of the drilling fluid;

determining a total organic carbon content in the rock formation unit using a computer;

determining a pyrite content in the rock formation unit using the computer;

generating an operating envelope of compatibility of the rock formation unit, wherein the operating envelope comprises:

i) the total organic carbon content in the rock formation unit is greater than 12 weight %, wherein the total organic carbon content is estimated from an offset well bulk density graph; and ii) the pyrite content in the rock formation unit is between 5-10 weight %, wherein the pyrite content is determined by elemental capture spectroscopy;

drilling a borehole in the selected region;

constantly analyzing, in real time, whether each said BHA and each said drilling fluid are incompatible for use in the rock formation, based upon the BHA properties, drilling fluid properties, the total organic carbon content, and the pyrite content, wherein the total organic carbon content is estimated from an offset well bulk density graph and the pyrite content is determined by elemental capture spectroscopy;

determining and selecting one of the BHAs and one of the drilling fluids which are compatible for use in the rock formation, wherein one of the BHA properties comprise a drill string of copper material selected from the group consisting of copper and copper-beryllium (CuBe) and one of the drilling fluid properties comprise a water-based drilling mud;

inserting the selected BHA and the selected drilling fluid into the borehole; and repetitively comparing the selected drill string of the BHAs and drilling fluids to the operating envelope of compatibility and reevaluating the selected one of the BHAs and drilling fluids.

2. The method of claim 1, wherein the total organic carbon content is calculated using a density log.

3. The method of claim 1, wherein the total organic carbon content is derived from a density log measured using a device comprising a logging tool.

4. The method of claim 1, wherein the total organic carbon content is derived from a density log measured using a device comprising a logging while drilling device.

* * * * *